US008849168B2

(12) United States Patent
Yamaki et al.

(10) Patent No.: US 8,849,168 B2
(45) Date of Patent: Sep. 30, 2014

(54) IMAGE FORMING APPARATUS WITH SUPPORT BELT DEFORMING MEMBER

(75) Inventors: Hideo Yamaki, Hachioji (JP); Satoshi Nishida, Saitama (JP); Yusuke Nishisaka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 197 days.

(21) Appl. No.: 13/450,735

(22) Filed: Apr. 19, 2012

(65) Prior Publication Data

US 2012/0275828 A1 Nov. 1, 2012

(30) Foreign Application Priority Data

Apr. 27, 2011 (JP) ..... 2011-098897

(51) Int. Cl.

| | |
|---|---|
| ***G03G 15/20*** | (2006.01) |
| ***G03G 15/01*** | (2006.01) |
| ***G03G 15/16*** | (2006.01) |

(52) U.S. Cl.

CPC .... *G03G 15/1615* (2013.01); *G03G 2215/1623* (2013.01); *G03G 15/189* (2013.01); *G03G 15/0131* (2013.01); *G03G 15/161* (2013.01); *G03G 2215/0135* (2013.01)

USPC ..... 399/313; 399/308

(58) Field of Classification Search

USPC ..... 399/313, 302, 308

See application file for complete search history.

(56) References Cited

U.S. PATENT DOCUMENTS

| | | | | |
|---|---|---|---|---|
| 8,385,793 | B2 | 2/2013 | Furuya et al. | |
| 2004/0013452 | A1 | 1/2004 | Choi | |
| 2009/0208259 | A1* | 8/2009 | Ishikawa | 399/313 |
| 2009/0317108 | A1 | 12/2009 | Taki et al. | |

FOREIGN PATENT DOCUMENTS

| | | | |
|---|---|---|---|
| JP | 07092843 | A | 4/1995 |
| JP | 09080926 | A | 3/1997 |
| JP | 2000293066 | A | 10/2000 |
| JP | 2003173092 | A | 6/2003 |
| JP | 2006-139168 | A | 6/2006 |
| JP | 2009-63794 | A | 3/2009 |
| JP | 2009-186828 | A | 8/2009 |
| JP | 2010-2838 | A | 1/2010 |
| JP | 2010-72311 | A | 4/2010 |
| JP | 2010-139603 | A | 6/2010 |
| JP | 2010134167 | A | 6/2010 |

OTHER PUBLICATIONS

Notification of Reasons for Refusal for Japanese Application No. 2011-098897; Date of Mailing: May 14, 2013 with English Translation.

(Continued)

*Primary Examiner* — Sandra Brase

(74) *Attorney, Agent, or Firm* — Cantor Colburn LLP

(57) ABSTRACT

An image forming apparatus includes a transfer belt, a pressure receiving roller, a suspension roller, a secondary transfer roller, and an endless support belt. The support belt is stretched over at least one of the pressure receiving roller and the suspension roller. When pressing the transfer belt between the pressure receiving roller and the secondary transfer roller, and nipping paper between the transfer belt and the secondary transfer roller, an angle defined by the portion, upstream from the secondary transfer roller, of the transfer belt and an imaginary line connecting the pressure-receiving-roller axis with the secondary-transfer-roller axis is less than 90 degrees. A part of the support belt is held between the transfer belt and at least one of the two rollers over which the support belt is stretched.

12 Claims, 13 Drawing Sheets

(56) References Cited

OTHER PUBLICATIONS

Notification of Reasons for Refusal for Japanese Application No. 2011-098896; Date of Mailing: May 21, 2013 with English Translation.

Japanese Office Action for Application No. 2011-098897; Date of Mailing, Jan. 7, 2014, with English Translation.

Non Final Office Action for U.S. Appl. No. 13/450,776 dated Nov. 29, 2013.

* cited by examiner

IMAGE FORMING APPARATUS WITH SUPPORT BELT DEFORMING MEMBER

BACKGROUND OF THE INVENTION

1. Field of the Invention

The present invention relates to an image forming apparatus.

2. Description of Related Art

Typical image forming apparatuses form an image on paper by performing primarily transfer of a toner image to a surface of an endless transfer belt, which is rotatably stretched over a plurality of rollers including a drive roller, a driven roller, and a backup roller, from a photoreceptor drum (an image carrier), and then performing secondary transfer of the toner image to the paper.

Such image forming apparatuses have a secondary transfer roller that presses the transfer belt against the backup roller. When a portion of the transfer belt on which a toner image has been primarily transferred passes through the backup roller, paper is allowed to pass between the transfer belt and the secondary transfer roller, so that the toner image is secondarily transferred on the paper.

In such image forming apparatuses, electrical discharge may occur across the gap between paper and the transfer belt in the vicinity of the entrance of a transfer nip area where the transfer belt is in proximity to the secondary transfer roller, during the secondary transfer of a toner image on the transfer belt to the paper. This causes disorder of the toner image, leading to formation of an abnormal image called toner scattering.

In the case of image formation on heavy and stiff thick paper, the trailing end of the thick paper is bent by being pre-nipped between the transfer belt and the secondary transfer roller, and the trailing end may hit the transfer belt as a reaction of its restoration. The transfer belt inwardly deflects due to the shock of such hitting, resulting in formation of a gap between the thick paper and the transfer belt. Electrical discharge may occur across the gap, leading to formation of the above-described abnormal image.

To reduce the formation of the abnormal image, the transfer belt should be stably driven against an applied load.

For example, in a typical image forming apparatus, a stiff drive belt is provided inside a transfer belt, and the drive belt rotates while supporting the transfer belt to stabilize rotation of the transfer belt (see, for example, Japanese Unexamined Patent Application Publication No. 2010-72311 (JP-A-2010-72311)).

In another image forming apparatus, an endless buffer hoop is disposed between a transfer belt and one of the rollers over which the transfer belt is stretched, so that the transfer belt is less affected by steps of the roller (see, for example, Japanese Unexamined Patent Application Publication No. 2009-63794 (JP-A-2009-63794)).

Unfortunately, in the image forming apparatus disclosed in JP-A-2010-72311, paper which is to be nipped for a transfer is conveyed in a direction substantially perpendicular to a line that connects the axis of the secondary transfer roller with the axis of a counter roller. Accordingly, the paper is not pre-nipped, and thus, the paper is not bent. This means that there is no possibility that the paper hits against the transfer belt with its rebound. In addition, in the apparatus of JP-A-2010-72311, while the drive belt supports the transfer belt in the vicinity of a photoreceptor drum, it is not intended to be a measure against a load on the transfer belt in the vicinity of the secondary transfer roller.

The technology disclosed in JP-A-2009-63794 is to achieve good contact between a cleaning blade for removing foreign substances on a surface of the transfer belt and the transfer belt. Thus, the technology is not intended to be a measure against a load on the transfer belt in the vicinity of the secondary transfer roller.

SUMMARY OF THE INVENTION

It is, therefore, a main object of the present invention to provide an image forming apparatus that can suppress the disorder of a toner image and can form excellent images.

To achieve the abovementioned object, an image forming apparatus reflecting one aspect of the present invention includes: a transfer belt having a surface on which a toner image is primarily transferred, the transfer belt rotating in a predetermined direction; a pressure receiving roller over which the transfer belt is stretched; a suspension roller over which the transfer belt is stretched, the suspension roller disposed upstream from the pressure receiving roller; a secondary transfer roller that presses the transfer belt against the pressure receiving roller; and an endless support belt stretched over at least one of the pressure receiving roller and the suspension roller, wherein when the transfer belt is pressed between the pressure receiving roller and the secondary transfer roller, and paper is nipped between the transfer belt and the secondary transfer roller for secondary transfer of the toner image onto the paper, an angle defined by a portion, upstream from the secondary transfer roller, of the surface of the transfer belt and an imaginary line connecting an axis of the pressure receiving roller with an axis of the secondary transfer roller is less than 90 degrees; and a part of the support belt is held between the transfer belt and the at least one of the pressure receiving roller and the suspension roller over which the support belt is stretched.

Preferably, the image forming apparatus further includes a support-belt deforming member that elastically deforms the support belt so as to expand an area where a portion, between the pressure receiving roller and the suspension roller, of a back side of the transfer belt comes into contact with the support belt.

Preferably, in the image forming apparatus, the support belt has substantially the same width as the transfer belt.

Preferably, in the image forming apparatus, the support belt has a width narrower than the width of the transfer belt, and is disposed at a position corresponding to a central portion of the transfer belt with respect to a width direction thereof.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Preferred embodiments of the present invention will now be described with reference to the accompanying drawings. Although technically preferred various restrictions are imposed to the following embodiments to carry out the present invention, the scope of the invention is not intended to be limited to the following embodiments and exemplary illustrations.

First Embodiment

Figure 1:
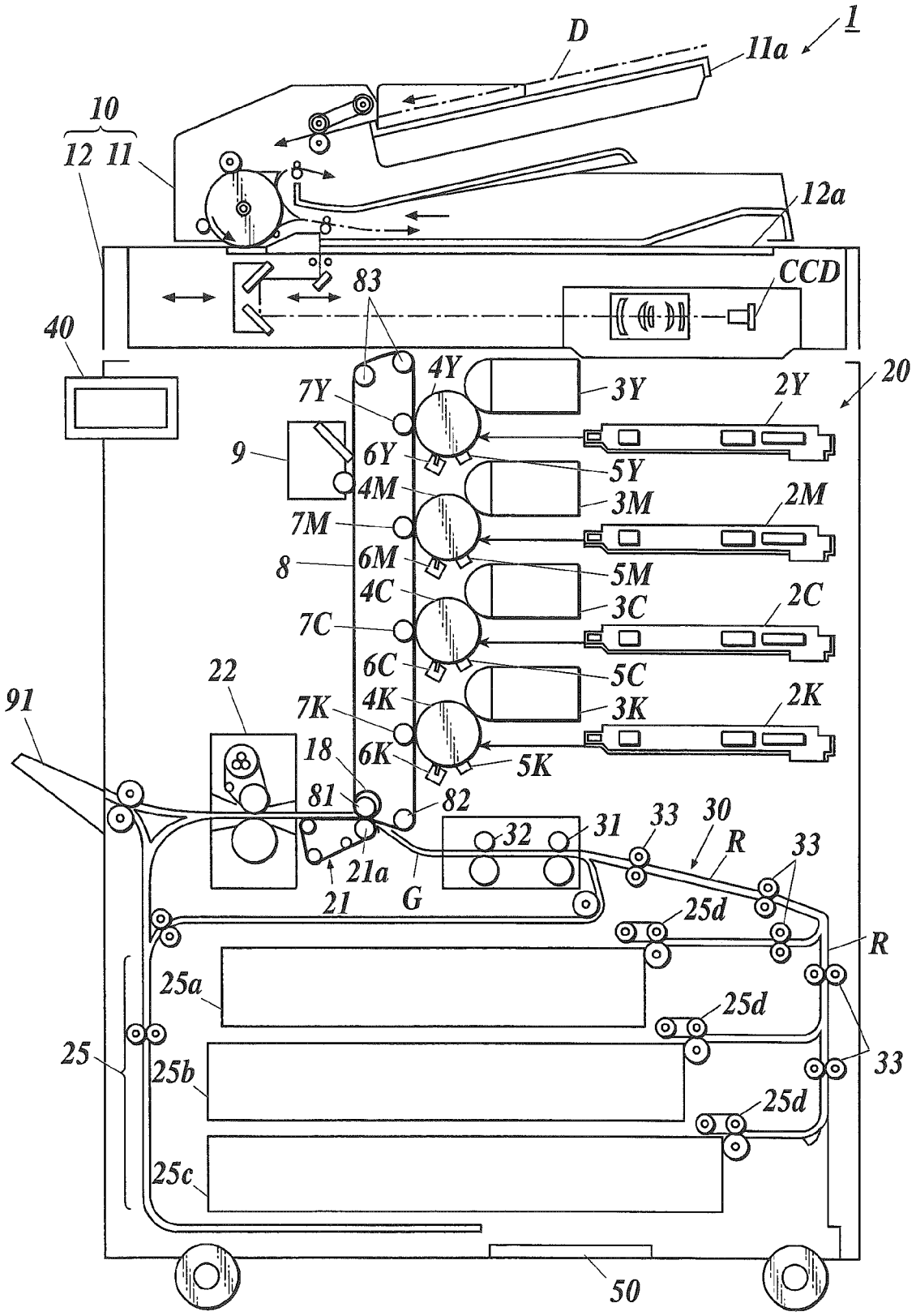
FIG. 1 is a schematic structural diagram illustrating an image forming apparatus.

FIG. 1 is a schematic structural diagram illustrating an image forming apparatus 1.

The image forming apparatus 1 has a copying function of reading an image from a document, forming an image on paper P on the basis of the read image data, and outputting the image; and a printing function of receiving page data containing image data and job data containing image forming conditions for each image data from external devices, forming an image on the paper P on the basis of the received page data and job data, and outputting the image.

As shown in FIG. 1, the image forming apparatus 1 includes an image reading unit 10, an image forming unit 20, a paper housing 25, a conveyance unit 30, an operational unit 40, and a controller 50.

The image reading unit 10 includes a document feeding section 11 called an automatic document feeder (ADF), and a reading section 12.

The reading section 12 reads an image on a document D placed on a contact glass 12*a* as a reading place with a charge coupled device (CCD).

The document D placed in a document tray 11*a* of the document feeding section 11 is conveyed onto the contact glass 12*a*, and the image or images on one or two sides of the document D are read by the CCD.

The term "image" includes text data such as letters and symbols, in addition to image data such as drawings and photographs.

The image (analog image signals) read by the image reading unit 10 is sent to a CPU (not shown) of the controller 50, and then the CPU performs various types of image processing such as analog processing, A/D conversion, shading correction, and image compression. The processed image is then separated into color components of yellow (Y), magenta (M), cyan (C), and black (K), and sent to the image forming unit 20 in the form of digital image data.

The image forming unit 20 performs electrographic image forming processing on the basis of the received image data.

The image forming unit 20 includes exposure sections 2Y, 2M, 2C, and 2K; development sections 3Y, 3M, 3C, and 3K; photoreceptor drums as image carriers 4Y, 4M, 4C, and 4K; charging sections 5Y, 5M, 5C, and 5K; cleaning sections 6Y, 6M, 6C, and 6K for the photoreceptor drums; primary transfer rollers 7Y, 7M, 7C, and 7K; a transfer belt 8; a support belt 18; a cleaning device 9 for the transfer belt; a secondary transfer section 21; and a fixing section 22.

In the image forming unit 20, a portion where the transfer belt 8 (a backup roller 81) is pressed against the secondary transfer section 21 (a secondary transfer roller 21*a*) functions as an image transfer section that transfers an image onto paper P for image formation.

The exposure sections 2Y, 2M, 2C, and 2K are each composed of a laser light source such as a laser diode (LD), a polygon mirror, and a plurality of lenses.

The exposure sections 2Y, 2M, 2C, and 2K scan to expose surfaces of the photoreceptor drums 4Y, 4M, 4C, and 4K, respectively, with laser beams on the basis of image data sent from the controller 50. Latent images are formed on the photoreceptor drums 4Y, 4M, 4C, and 4K charged by the charging sections 5Y, 5M, 5C, and 5K, respectively, through such scanning exposure with laser beams, and thus an image is written.

The latent images formed on the photoreceptor drums 4Y, 4M, 4C, and 4K are rendered visible through development with toner held in the corresponding development sections 3Y, 3M, 3C, and 3K, respectively, so that toner images are formed on the respective photoreceptor drums 4Y, 4M, 4C, and 4K.

The toner images carried on the photoreceptor drums 4Y, 4M, 4C, and 4K are primarily transferred onto the transfer belt 8 by the primary transfer rollers 7Y, 7M, 7C, and 7K, respectively.

After transfer of the toner images, residual toner is removed from the surfaces of the photoreceptor drums 4Y, 4M, 4C, and 4K by the cleaning sections 6Y, 6M, 6C, and 6K.

The transfer belt 8 is an endless belt rotatably stretched over a plurality of rollers (for example, the backup roller 81, a suspension roller 82, and a tension roller 83), and rotated clockwise in the drawing along with rotation of the rollers. The suspension roller 82 is disposed upstream from the backup roller 81 which functions as a pressure receiving roller.

The transfer belt 8 is pressed against the photoreceptor drums 4Y, 4M, 4C, and 4K by the primary transfer rollers 7Y, 7M, 7C, and 7K, respectively. As a result, the toner images developed on the surfaces of the photoreceptor drums 4Y, 4M, 4C, and 4K are transferred onto the surface of the transfer belt 8 at the transfer positions pressed by the primary transfer rollers 7Y, 7M, 7C, and 7K, respectively (primary transfer).

In addition, the transfer belt 8 comes into tight contact with the paper P at another transfer position pressed by the backup roller 81 as a pressure receiving roller and the secondary transfer roller 21*a* of the secondary transfer section 21, so that the toner images formed through primary transfer are transferred onto the paper P (secondary transfer).

After the toner images are transferred onto the paper P by the secondary transfer section 21, the paper P is separated from the transfer belt 8 by means of a large curvature of the paper and electrostatic force, and sent to the fixing section 22.

After transfer of the toner images onto the paper P, the residual toner is removed from the transfer belt 8 by the cleaning device 9.

In addition, an endless support belt or endless support belts is/are stretched over one or both of the backup roller 81 and the suspension roller 82, over which the transfer belt 8 is stretched, on the back side of the transfer belt 8.

Figure 2:
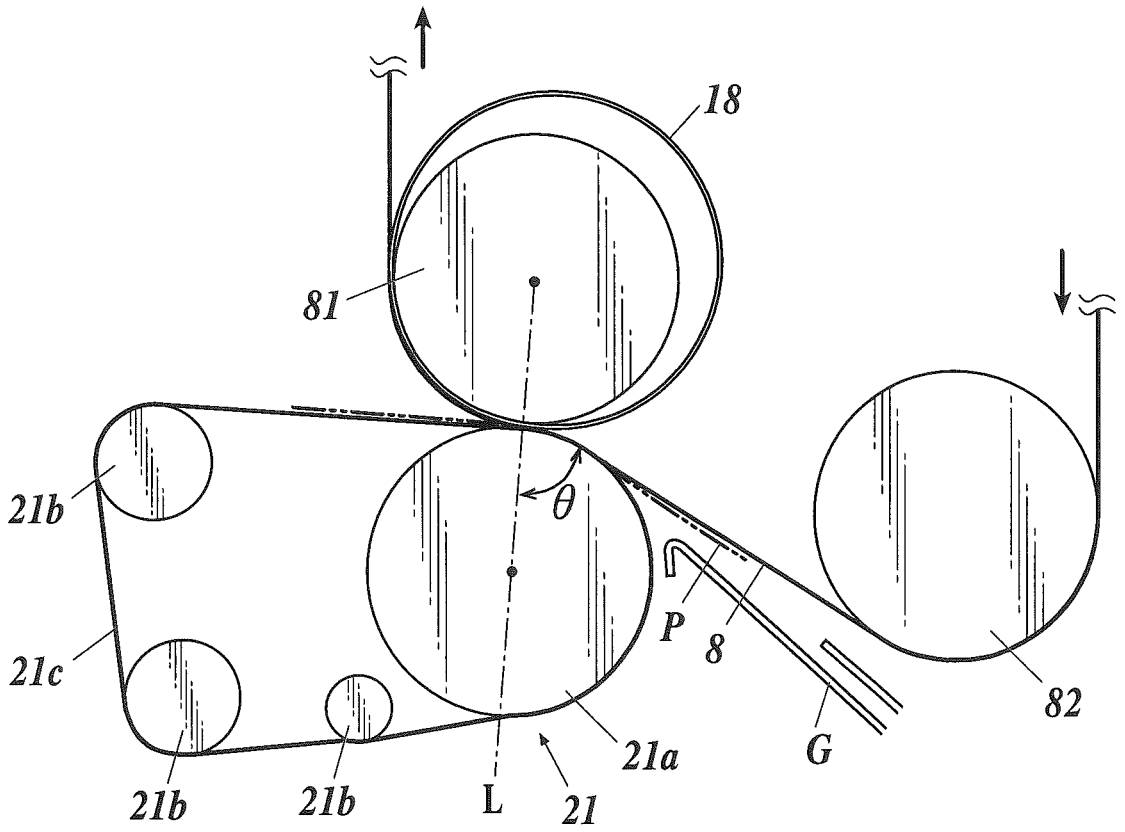
FIG. 2 is an enlarged view illustrating a support belt and its neighborhood in a first embodiment, showing the position of a secondary transfer roller during a non-secondary-transfer mode.
Figure 3:
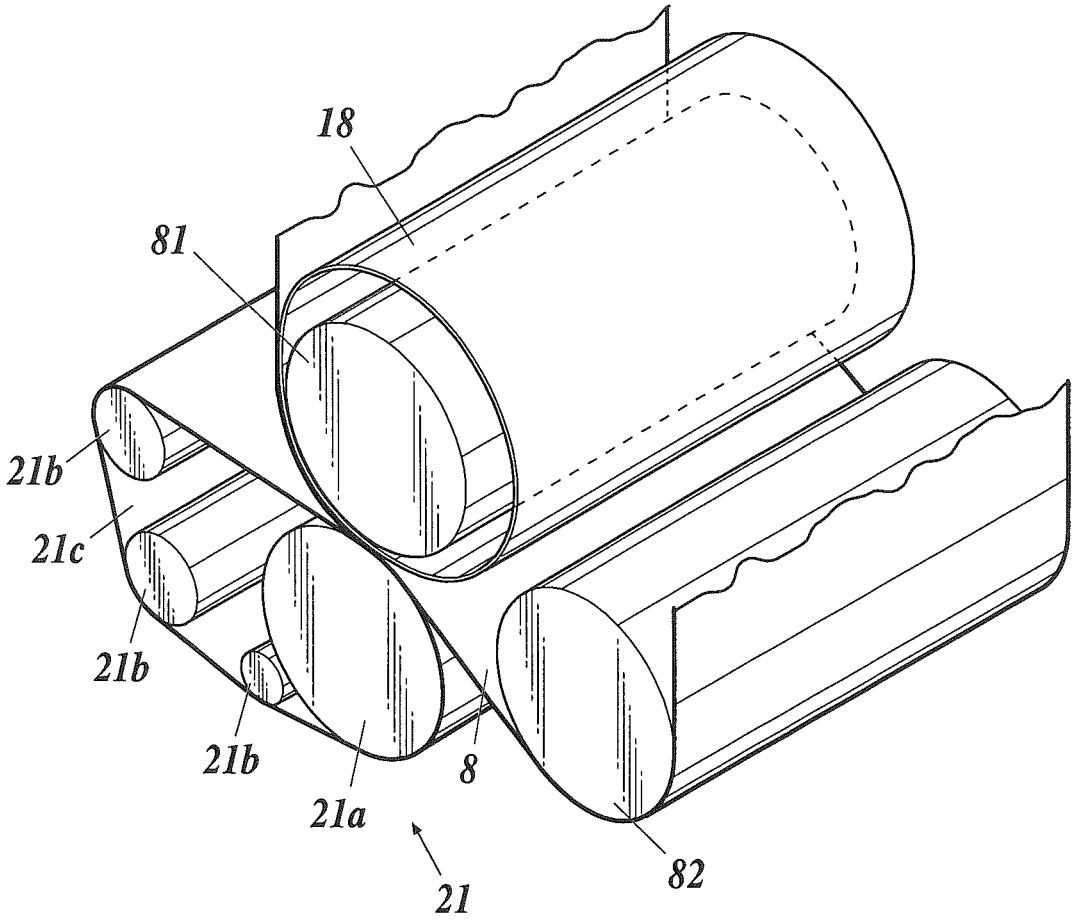
FIG. 3 is a perspective view illustrating the support belt and its neighborhood in the first embodiment.

In the first embodiment, as shown in FIGS. 2 and 3, a support belt 18 is stretched over the backup roller 81, and part of the support belt 18 around the backup roller 81 is held between the backup roller 81 and the transfer belt 8.

The support belt 18 is, for example, an elastic tubular member having a Young's modulus of, for example, about 3 to about 7 MPa/mm$^2$ composed of conductive resin such as polyimide (PI), polyamide-imide (PAI), polycarbonate (PC), and polyphenylene sulfide (PPS).

As shown in FIG. 3, the support belt 18 has substantially the same width as the transfer belt 8, and is in contact with the back of the transfer belt 8. In other words, the support belt 18 is in contact with the back of the transfer belt 8 across the full width of the transfer belt 8.

The support belt 18 prevents deflection of the transfer belt 8 toward the backup roller 81 when the transfer belt 8 is pushed by the paper P during secondary transfer, and enables the transfer belt 8 to rotate stably.

As shown in FIGS. 2 and 3, the secondary transfer section 21 includes the secondary transfer roller 21*a*, a plurality of tension rollers 21*b*, and an endless belt 21*c* rotatably stretched over the secondary transfer roller 21*a* and the tension rollers 21*b*.

The secondary transfer section 21 can be moved by an undepicted drive mechanism. During a non-secondary-transfer mode, the secondary transfer section 21 is arranged such that the backup roller 81 is separated from the secondary transfer roller 21*a*. On the other hand, during a secondary-transfer mode, the position of the secondary transfer roller 21*a* is shifted and the secondary transfer section 21 is arranged such that the transfer belt 8 is pressed by the secondary transfer roller 21*a* against the backup roller 81 (see FIG. 2).

In the image forming apparatus 1, when the secondary transfer section 21 is arranged such that the transfer belt 8 is pressed between the backup roller 81 and the secondary transfer roller 21*a*, and when the paper P is nipped between the transfer belt 8 and the secondary transfer roller 21*a* for secondary transfer of the toner images onto the paper P (see FIG. 2), the angle θ defined by a portion, upstream from the secondary transfer roller 21*a*, of the surface of the transfer belt 8 and an imaginary line L (or an imaginary surface), which connects the axis of the backup roller 81 with the axis of the secondary transfer roller 21*a*, is less than 90 degrees.

Since the angle θ defined by the surface of the transfer belt 8, which is in the upstream region from the secondary transfer roller 21*a*, and the imaginary line L is less than 90 degrees as described above, the paper P is pre-nipped between the secondary transfer roller 21*a* and the transfer belt 8 along the peripheral surface of the secondary transfer roller 21*a*, and then, the paper P is nipped by the backup roller 81 and the secondary transfer roller 21*a* for transfer. The paper P is nipped for transfer while an electric field is formed between the backup roller 81 receiving a voltage and the secondary transfer roller 21*a* connected to the ground, so that the toner images is secondarily transferred.

The fixing section 22 fixes the toner images transferred on the paper P. As a result, the toner images are fixed on the paper P, resulting in formation of an image. After the fixing section 22 has fixed the toner images, the paper P is discharged to an output tray 91.

Specifically, image formation by the image forming unit 20 means sequential operation including formation of the latent images on the photoreceptor drums 4Y, 4M, 4C, and 4K with the exposure sections 2Y, 2M, 2C, and 2K, development of the toner images through application of toner to the latent images, primary transfer of the toner images onto the transfer belt 8, secondary transfer of the toner images onto the paper P, and fixing of the toner images transferred on the paper P by the fixing section 22.

The paper housing 25 includes a plurality of paper trays 25*a*, 25*b*, and 25*c* and a plurality of paper feeders 25*d*.

The paper trays 25*a*, 25*b*, and 25*c* store different types of paper which are beforehand set and identified depending on the weight or size of paper P.

The paper feeders 25*d* feed the paper P stored in each paper tray to the conveyance unit 30 one by one from the top.

The conveyance unit 30 is composed of a conveyance path R from the paper housing 25 to the image transfer section (the transfer belt 8 and the secondary transfer section 21), and a plurality of conveyance roller pairs (31, 32, and 33) disposed along the conveyance path R to convey the paper P fed from the paper housing 25 to the image transfer section. Part of the conveyance path R extends to a path from the image transfer section to the output tray 91 and a path for turning over the paper.

The conveyance unit 30 includes conveyance roller pairs including resist rollers 32 proximally disposed upstream from the image transfer section (the transfer belt 8 and the secondary transfer section 21) on the conveyance path R, loop rollers 31 proximally disposed upstream from the resist rollers 32, and feed rollers 33 disposed between the loop rollers 31 and the paper trays (the paper feeders 25*d*).

The loop rollers 31 correct crook (skew) of the paper P. In detail, the paper P passes through the loop rollers 31 and bumps against the resist rollers 32 under suspension. After bumping against the resist rollers 32, the paper P is still conveyed by the loop rollers 31 and thus curled, and the skew of the paper P is corrected in accordance with a nip line of the resist rollers 32.

The resist rollers 32 shake in a direction orthogonal to the conveyance direction of the paper P while holding the paper P being conveyed for image formation so that the paper P is aligned with the toner images primarily transferred onto the transfer belt 8.

The operational unit 40 includes, for example, a liquid crystal display panel and a touch panel provided on the screen of the liquid crystal display panel. Through a touch operation of an operational key displayed on the liquid crystal display panel, the position of a touched portion on the touch panel is detected, and an operational signal corresponding to the detected position is sent to the controller 50.

The controller 50 of the image forming apparatus 1 comprehensively controls the components of the apparatus, and is connected to the image reading unit 10, the image forming unit 20, the conveyance unit 30, and the operational unit 40.

The functions of the support belt 18 provided on the back side of the transfer belt 8 in the image forming apparatus 1 are now described.

In the image forming apparatus 1, the secondary transfer section 21 is arranged such that the backup roller 81 is separated from the secondary transfer roller 21*a* during the non-secondary-transfer mode.

As shown in FIG. 2, the secondary transfer section 21 is arranged such that the transfer belt 8 is held between the backup roller 81 and the secondary transfer roller 21*a* during the secondary-transfer mode.

In this mode, the support belt 18 held together with the transfer belt 8 between the backup roller 81 and the secondary transfer roller 21*a* comes into tight contact with the back of the transfer belt 8.

In this way, the support belt 18 is in tight contact with the back of the transfer belt 8. Accordingly, when the secondary transfer section 21 is arranged such that the transfer belt 8 is held between the backup roller 81 and the secondary transfer roller 21*a*, and when the paper P is nipped between the transfer belt 8 and the secondary transfer roller 21*a* for secondary transfer of the toner images onto the paper P, the transfer belt 8 is not deflected toward the backup roller 81 even if the transfer belt 8 is pushed by the paper P.

Specifically, the stiff paper P such as thick paper, which is conveyed along the conveyance path R, is nipped between the secondary transfer section 21 and the transfer belt 8, and then exits from the guide G on the conveyance path R. Even if the trailing end of the stiff paper P hits the transfer belt 8 as a reaction of its restoration at the timing of the exit, the transfer belt 8 is supported by the support belt 18 so as not to be deflected toward the backup roller 81. As a result, movement disorder of the transfer belt 8 is prevented. In this way, the transfer belt 8 is not deflected toward the backup roller 81 and thus the movement of the transfer belt 8 is stable, which eliminates the formation of a gap that induces electrical discharge between the paper P and the transfer belt 8. As a result, the disorder of the toner image due to the electrical discharge does not occur, leading to preferable image formation based on excellent secondary transfer.

In contrast, if the support belt 18 is not provided in a region corresponding to the back of the transfer belt 8 held between the backup roller 81 and the secondary transfer roller 21*a* as in the conventional technology, the transfer belt 8 may be deflected by 3 to 5 mm due to hitting of the trailing end of the stiff paper P against the transfer belt 8, so that a gap to induce electrical discharge is formed between the paper P and the transfer belt 8. This causes disorder of the toner image, leading to formation of an abnormal image.

As described above, the image forming apparatus 1 of the first embodiment has the support belt 18 that comes into tight contact with the back of the transfer belt 8 to support the transfer belt 8 so that the transfer belt 8 is not deflected toward the backup roller 81 when the transfer belt 8 is pushed by the paper P during secondary transfer. This prevents deflection of the transfer belt 8 toward the backup roller 81 even if the trailing end of the stiff paper P such as thick paper hits the transfer belt 8. As a result, the transfer belt 8 is prevented from deviating from a proper pathway.

In this way, the support belt 18 stabilizes the movement of the transfer belt 8 during secondary transfer. This can prevent the formation of a gap that induces electrical discharge between the paper P and the transfer belt 8, leading to suppression of the disorder of the toner image due to the electrical discharge. As a result, the image forming apparatus 1 can form excellent images.

Figure 4:
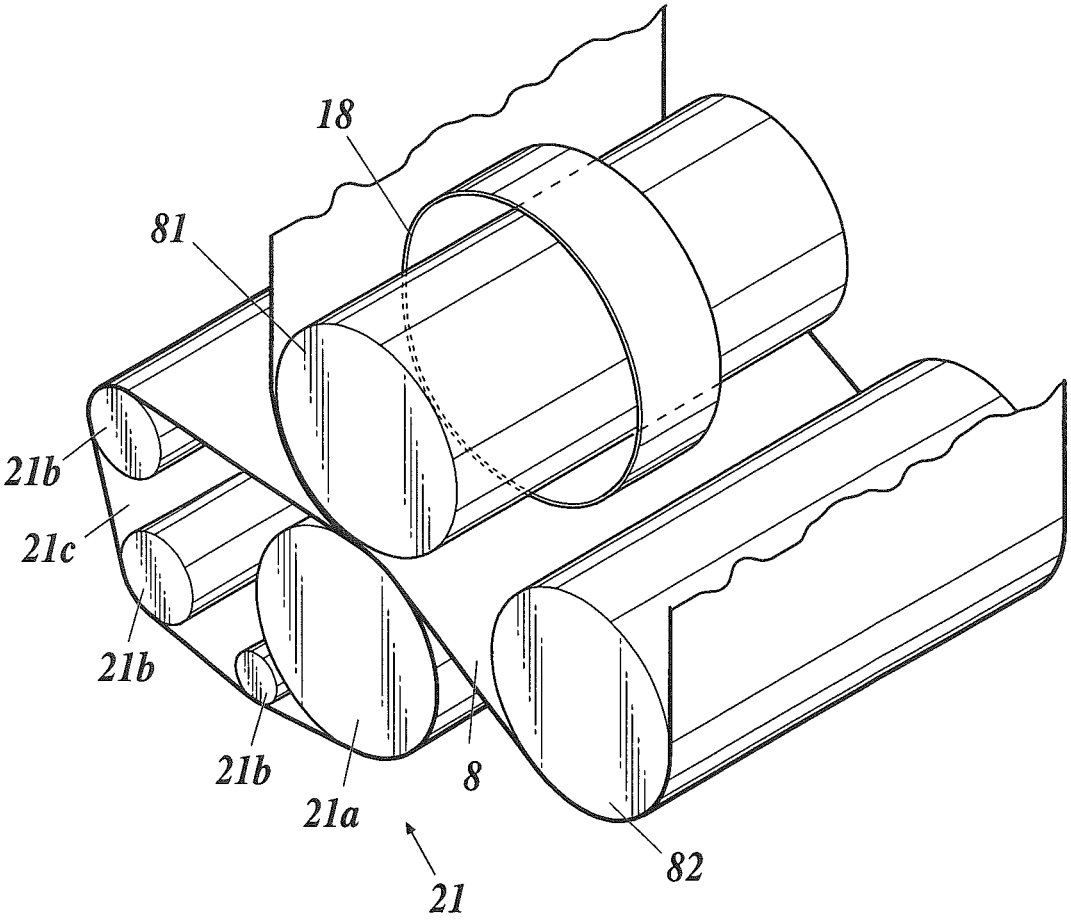
FIG. 4 is a perspective view illustrating a modification of the support belt in the first embodiment.

As shown in FIG. 3, the support belt 18 preferably has substantially the same width as the transfer belt 8 so as to be in contact with the back of the transfer belt 8 across the full width of the transfer belt 8. When the stiff paper P, such as thick paper, exits from the guide G on the conveyance path R and when the trailing end of the paper P hits against the transfer belt 8, the shock caused by the hitting may concentrate on the central portion of the transfer belt 8 with respect to the width direction thereof, in some cases. In this case, it is basically sufficient that the deflection of the transfer belt 8 is restricted only in the central portion with respect to the width direction of the belt 8. In such a case, the width of the support belt 18 can be narrower than the width of the transfer belt 8 as long as the support belt 18 is provided in the region corresponding to the central portion of the transfer belt 8 with respect to the width direction thereof, as shown in FIG. 4.

The first embodiment is not limited to the above-described examples.

Figure 5:
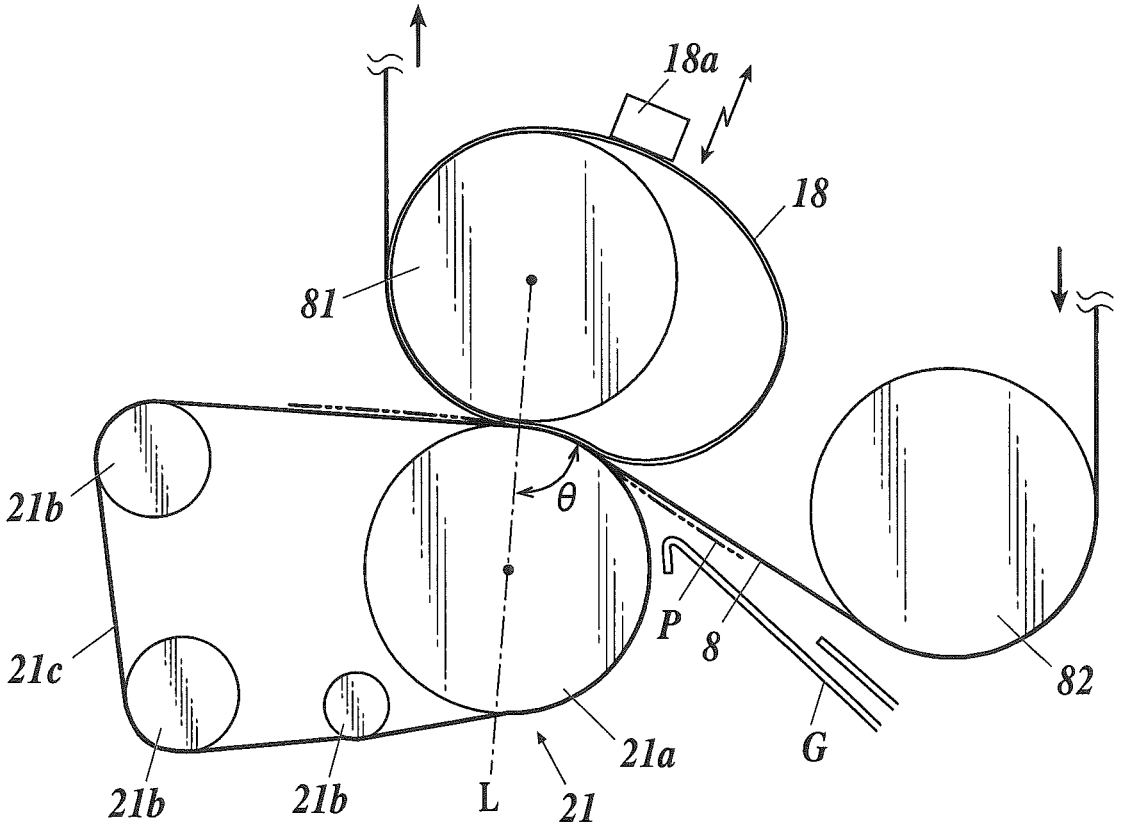
FIG. 5 illustrates the support belt and a support-belt deforming member in the first embodiment.

For example, as shown in FIG. 5, a preferable embodiment of the image forming apparatus includes a support-belt deforming member 18*a*. The support-belt deforming member 18*a* comes in contact with the outer surface of the support belt 18, and moves closer to the backup roller 81 over which the support belt 18 is stretched. In this way, the support-belt deforming member 18*a* elastically deforms the support belt 18 such that the loop of the support belt 18 is flattened.

The support-belt deforming member 18*a* presses the outer surface of the support belt 18 to elastically deform the support belt 18 so as to expand an area where a portion, between the backup roller 81 and the suspension roller 82, of the back of the transfer belt 8 comes into contact with the support belt 18.

The support-belt deforming member 18*a* is, for example, fixed at a desired position by undepicted retainers such as screws and pins, so that the deformation level of the support belt 18 is adjusted depending on the distance between the support-belt deforming member 18*a* and the backup roller 81. Thereby, the area of contact between the back of the transfer belt 8 and the support belt 18 is adjusted.

In this way, since the support-belt deforming member 18*a* moves to elastically deform the support belt 18 so as to expand the area where the back of the transfer belt 8 comes into tight contact with the support belt 18, the transfer belt 8 is more securely supported by the support belt 18 so as not to be deflected toward the backup roller 81. As a result, the movement of the transfer belt 8 becomes more stable.

This can prevent the formation of a gap between the paper P and the transfer belt 8 more securely, and thus, prevent the disorder of the toner image due to the electrical discharge, leading to an improvement in image formation.

Figure 6:
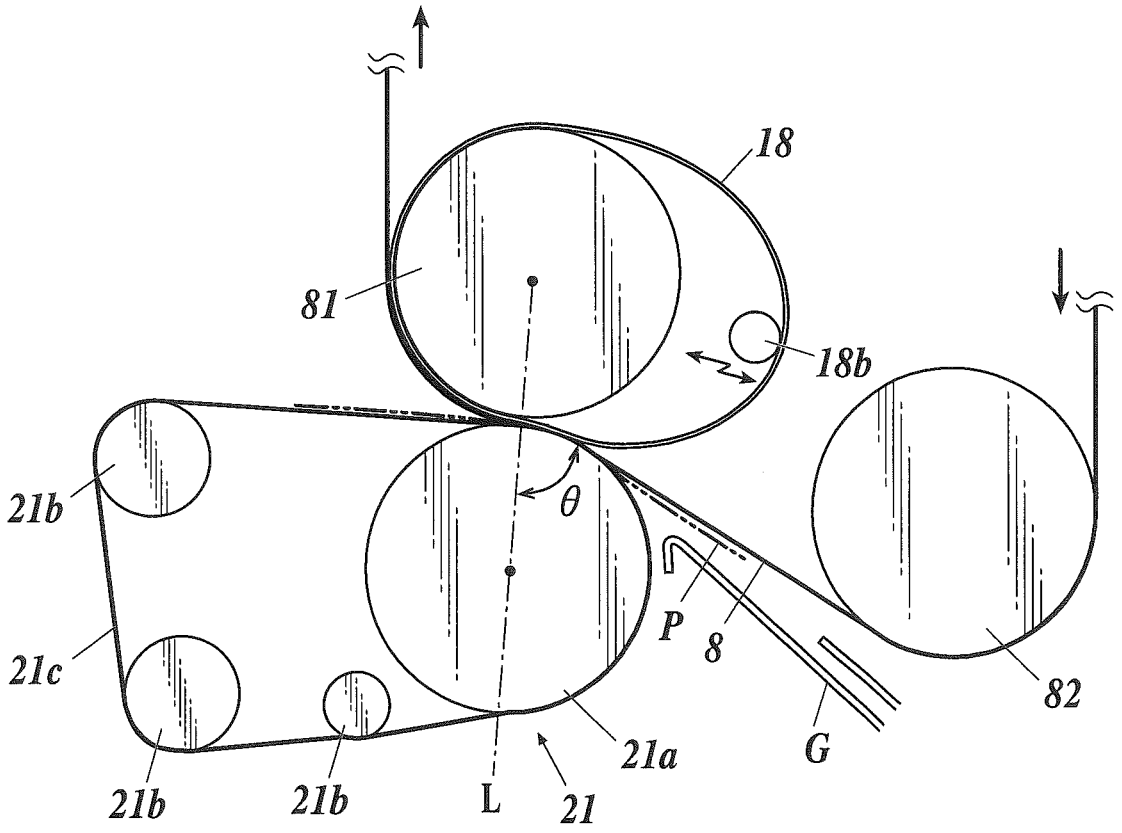
FIG. 6 illustrates the support belt and another support-belt deforming member in the first embodiment.

As shown in FIG. 6, another preferable embodiment of the image forming apparatus includes a support-belt deforming member 18*b*. The support-belt deforming member 18*b* comes in contact with the inner surface of the support belt 18, and moves away from the backup roller 81 over which the support belt 18 is stretched. In this way, the support belt 18 is stretched and elastically deformed.

The support-belt deforming member 18*b* presses the inner surface of the support belt 18 to elastically deform the support belt 18 so as to expand an area where a portion, between the backup roller 81 and the suspension roller 82, of the back of the transfer belt 8 comes into contact with the support belt 18.

The support-belt deforming member 18*b* is, for example, fixed at a desired position by undepicted retainers such as screws and pins, so that the deformation level of the support belt 18 is adjusted depending on the distance between the support-belt deforming member 18*b* and the backup roller 81. Thereby, the area of contact between the back of the transfer belt 8 and the support belt 18 is adjusted.

In this way, since the support-belt deforming member 18*b* moves to elastically deform the support belt 18 so as to expand the area where the back of the transfer belt 8 is in tight contact with the support belt 18, the transfer belt 8 is more securely supported by the support belt 18 so as not to be deflected toward the backup roller 81. As a result, the movement of the transfer belt 8 becomes more stable.

This can prevent the formation of a gap between the paper P and the transfer belt 8 more securely, and thus, prevent the disorder of the toner image due to the electrical discharge, leading to an improvement in image formation.

Figure 7:
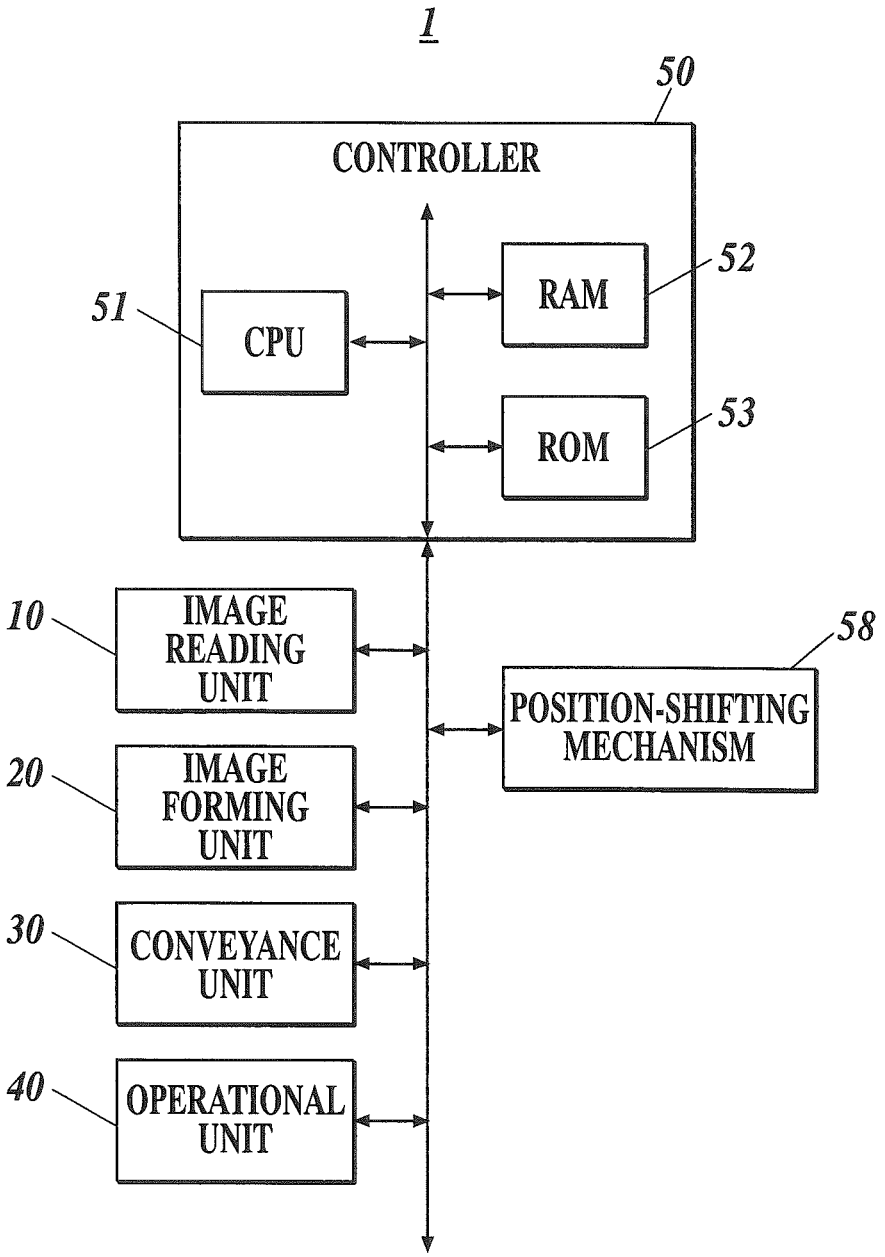
FIG. 7 is a block diagram illustrating a control system of the image forming apparatus.

To move the support-belt deforming member 18*a* or 18*b*, the support-belt deforming member 18*a* or 18*b* does not necessarily need to be fixed at a desired position by the undepicted retainers. For example, a position-shifting mechanism 58 may be activated to move the support-belt deforming member 18*a* or 18*b* so as to elastically deform the support belt 18. FIG. 7 illustrates a control system of the image forming apparatus 1.

For example, as shown in FIG. 7, the controller 50 of the image forming apparatus 1 comprehensively controls the components of the apparatus, and is connected to the image reading unit 10, the image forming unit 20, the conveyance unit 30, the operational unit 40, and the position-shifting mechanism 58.

The position-shifting mechanism 58 moves the support-belt deforming member 18*a* or 18*b*, which is connected to the position-shifting mechanism 58 or which is disposed to receive the driving force from the position-shifting mechanism 58, in a predetermined direction so that the support belt 18 is elastically deformed. The position-shifting mechanism 58 may include a mechanism of activating an eccentric cam through rotation of an eccentric shaft with a motor, or include a rack-and-pinion mechanism, for example.

The controller 50 includes a central processing unit (CPU) 51, a random access memory (RAM) 52, and a read only memory (ROM) 53.

The CPU 51 reads a specified program among system programs and a variety of application programs stored in the ROM 53, expands the read program to the RAM 52, and executes various processes in cooperation with the program expanded to the RAM 52 for central control of the components of the image forming apparatus 1.

The RAM 52, which is typically a volatile memory, has a work area that stores various programs to be executed by the CPU 51 and data associated with the programs, and temporarily stores such information.

The ROM 53 stores, for example, the system program to be executed by the image forming apparatus 1 (CPU 51), processing programs to be executed with the system program, and data to be used for execution of the processing programs. For example, the ROM 53 stores a thick-paper print mode program that activates the position-shifting mechanism 58 to elastically deform the support belt 18 in the case where the thick-paper print mode, which is to form images on stiff paper P such as thick paper, is selected.

The thick-paper print mode program stored in the ROM 53 allows the controller 50 to execute a control process that activates the position-shifting mechanism 58 to move the support-belt deforming member 18*a* or 18*b* at least when the paper P (thick paper) is nipped between the transfer belt 8 and the secondary transfer roller 21*a*.

Upon execution of the thick-paper print mode program by the CPU 51, the controller 50 activates the position-shifting mechanism 58 to move the support-belt deforming member 18*a* or 18*b* so that the support belt 18 is elastically deformed.

For example, if the image forming apparatus 1 is switchable between a plain-paper print mode for image printing on plain paper such as copy paper (high-quality paper) and the thick-paper print mode for image printing on heavy thick paper, the position-shifting mechanism 58 is not activated during the plain-paper print mode; and on the other hand, the position-shifting mechanism 58 is activated to move the support-belt deforming member 18*a* or 18*b* to elastically deform the support belt 18 during the thick-paper print mode.

In this way, the thick-paper print mode is selected to activate the position-shifting mechanism 58 for image printing on the stiff thick paper, so that the support-belt deforming member 18*a* or 18*b* moves to elastically deform the support belt 18. Thereby, the area where the back of the transfer belt 8 is in tight contact with the support belt 18 is expanded. As a result, the transfer belt 8 is supported by the support belt 18 so as not to be deflected toward the backup roller 81, leading to a stable movement of the transfer belt 8.

This can prevent the formation of a gap between the paper P and the transfer belt 8, and thus, suppresses the disorder of the toner image due to the electrical discharge, leading to an improvement in image formation.

The support belt 18 can be elastically deformed only when the transfer belt 8 needs to be supported so as not to yield to a push given by the paper P, i.e., at the time of printing of thick paper, for example. This reduces the load on the support belt 18 and on the transfer belt 8 pressed by the support belt 18. In addition, such a reduction in the load on the support belt 18 and on the transfer belt 8 suppresses the deterioration of the support belt 18 and of the transfer belt 8, leading to prolonging lives of the support belt 18 and the transfer belt 8.

Furthermore, the position-shifting mechanism 58 is activated to move the support-belt deforming member 18*a* or 18*b* immediately before nipping of the paper P (thick paper) between the transfer belt 8 and the secondary transfer roller 21*a*, and the activation of the position-shifting mechanism 58 lasts only during the passage of the paper P between the transfer belt 8 and the secondary transfer roller 21*a*. This further limits the time of elastic deformation of the support belt 18, and thus the load on the support belt 18 and on the transfer belt 8 is further reduced, leading to prolonging lives of the support belt 18 and the transfer belt 8.

In this way, the position-shifting mechanism 58 is activated to elastically deform the support belt 18 only during print of thick paper. This reduces the load on the support belt 18 and on the transfer belt 8 compared with a case where the support-belt deforming member 18*a* or 18*b* is fixed at a desired position by the undepicted retainers and where the support belt 18 is continuously elastically deformed. Thereby, the lives of the support belt 18 or the transfer belt 8 are further prolonged.

Second Embodiment

A second embodiment of the image forming apparatus according to the present invention is now described. The configurations similar to those in the first embodiment are designated by the same numerals and their overlapping description is omitted.

In the image forming apparatus 1, an endless support belt is stretched over at least one of a backup roller 81 and a suspension roller 82, over which a transfer belt 8 is stretched, in the vicinity of the back of the transfer belt 8.

Figure 8:
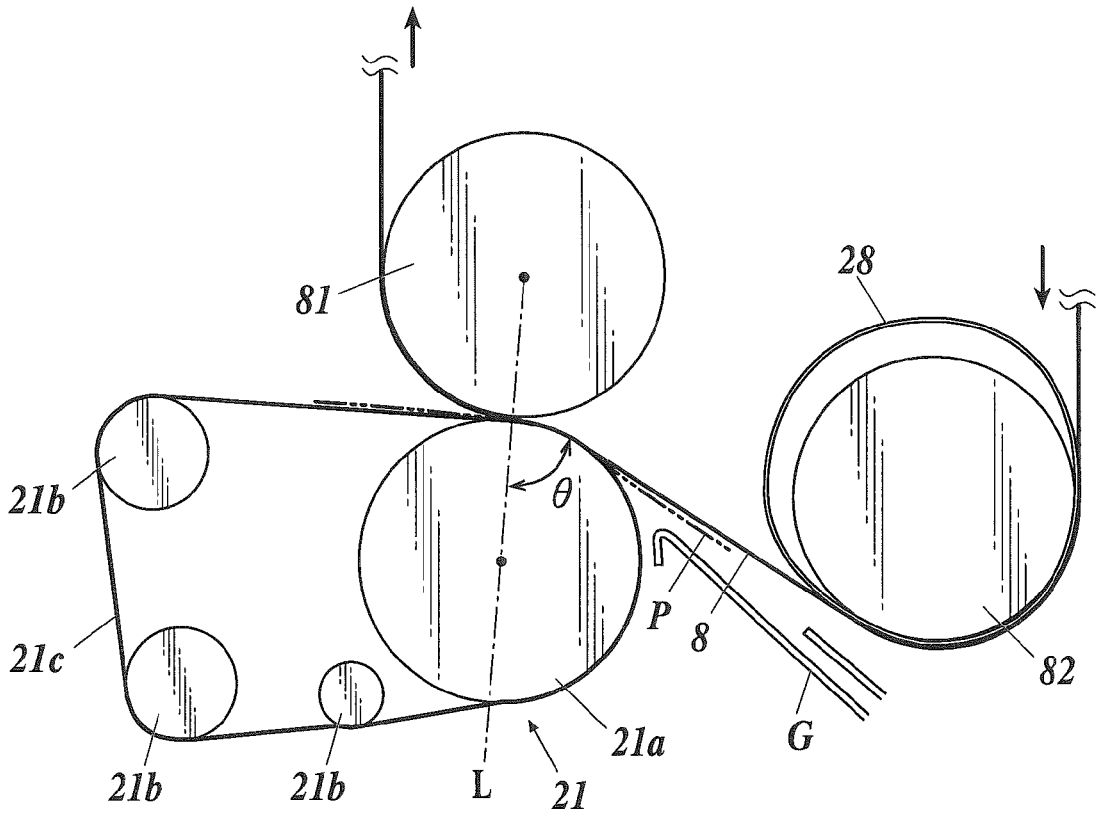
FIG. 8 illustrates a support belt and its neighborhood in a second embodiment.

In the second embodiment, as shown in FIG. 8, a support belt 28 is stretched over the suspension roller 82, and part of the support belt 28 around the suspension roller 82 is held between the suspension roller 82 and the transfer belt 8.

The support belt 28 is, for example, an elastic tubular member having a Young's modulus of, for example, about 3 to about 7 $MPa/mm^2$ composed of conductive resin such as polyimide (PI), polyamide-imide (PAI), polycarbonate (PC), and polyphenylene sulfide (PPS).

The support belt 28 has substantially the same width as the transfer belt 8, and is in contact with the back of the transfer belt 8. In other words, the support belt 28 is in contact with the back of the transfer belt 8 across the full width of the transfer belt 8.

The support belt 28 prevents the deflection of the transfer belt 8 toward the backup roller 81 (or the suspension roller 82)

due to the push given by the paper P during secondary transfer, and enables the transfer belt 8 to rotate stably.

As shown in FIG. 8, a secondary transfer section 21 is arranged such that the transfer belt 8 is held between the backup roller 81 and a secondary transfer roller 21*a* during the secondary-transfer mode of the image forming apparatus 1.

In this mode, the support belt 28 held between the suspension roller 82 and the transfer belt 8 comes into tight contact with the back of the transfer belt 8.

In this way, the support belt 28 is in tight contact with the back of the transfer belt 8. Accordingly, when the secondary transfer section 21 is arranged such that the transfer belt 8 is held between the backup roller 81 and the secondary transfer roller 21*a*, and when the paper P is nipped between the transfer belt 8 and the secondary transfer roller 21*a* for secondary transfer of the toner images onto the paper P, the transfer belt 8 is not deflected toward the backup roller 81 and the suspension roller 82 even if the transfer belt 8 is pushed by the paper P.

Specifically, the stiff paper P such as thick paper, which is conveyed along the conveyance path R, is nipped between the secondary transfer section 21 and the transfer belt 8, and then exits from the guide G on the conveyance path R. Even if the trailing end of the stiff paper P hits the transfer belt 8 as a reaction of its restoration at the timing of the exit, the transfer belt 8 is supported by the support belt 28 so as not to be deflected toward the backup roller 81 and the suspension roller 82. As a result, movement disorder of the transfer belt 8 is prevented. In this way, the transfer belt 8 is not deflected toward the backup roller 81 and the suspension roller 82, and thus the movement of the transfer belt 8 is stable, which eliminates the formation of a gap that induces electrical discharge between the paper P and the transfer belt 8. As a result, the disorder of the toner image due to the electrical discharge does not occur, leading to preferable image formation based on excellent secondary transfer.

As described above, the image forming apparatus 1 of the second embodiment has the support belt 28 that comes into tight contact with the back of the transfer belt 8 to support the transfer belt 8 so as to prevent deflection of the transfer belt 8 toward the backup roller 81 and the suspension roller 82 due to the push given by the paper P during secondary transfer. This prevents deflection of the transfer belt 8 toward the backup roller 81 and the suspension roller 82 even if the trailing end of the stiff paper P such as thick paper hits the transfer belt 8. As a result, the transfer belt 8 is prevented from deviating from a proper pathway.

In this way, the support belt 28 stabilizes the movement of the transfer belt 8 during secondary transfer. This can prevent the formation of a gap that induces electrical discharge between the paper P and the transfer belt 8, leading to suppression of the disorder of the toner image due to the electrical discharge. As a result, the image forming apparatus 1 can form excellent images.

The support belt 28 preferably has substantially the same width as the transfer belt 8 so as to be in contact with the back of the transfer belt 8 across the full width of the transfer belt 8. When the stiff paper P, such as thick paper, exits from the guide G on the conveyance path R and when the trailing end of the paper P hits against the transfer belt 8, the shock caused by the hitting may concentrate on the central portion of the transfer belt 8 with respect to the width direction thereof, in some cases. In this case, it is basically sufficient that the deflection of the transfer belt 8 is restricted only in the central portion with respect to the width direction of the belt 8. In such a case, the width of the support belt 28 can be narrower than the width of the transfer belt 8 as long as the support belt 28 is provided in the region corresponding to the central portion of the transfer belt 8 with respect to the width direction thereof.

The second embodiment is not limited to the above-described examples.

Figure 9:
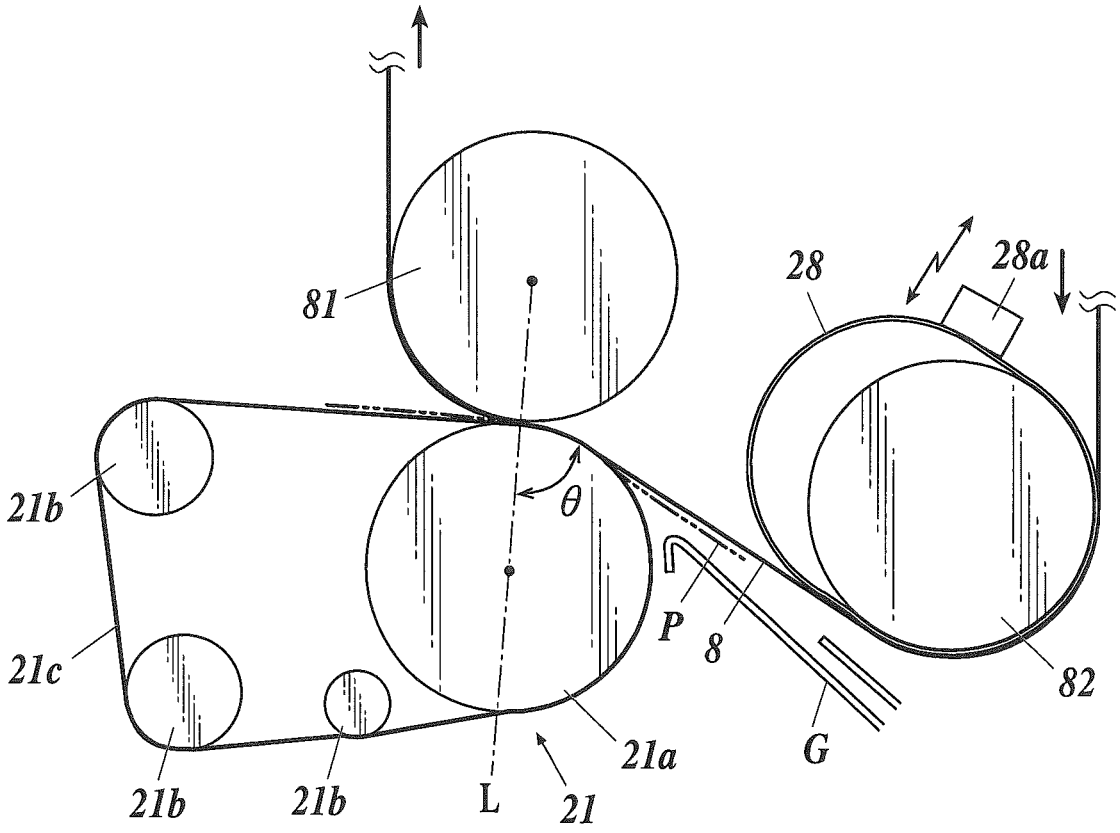
FIG. 9 illustrates the support belt and a support-belt deforming member in the second embodiment.

For example, as shown in FIG. 9, a preferable embodiment of the image forming apparatus includes a support-belt deforming member 28*a*. The support-belt deforming member 28*a* comes in contact with the outer surface of the support belt 28, and moves closer to the suspension roller 82 over which the support belt 28 is stretched. In this way, the support-belt deforming member 28*a* elastically deforms the support belt 28 such that the loop of the support belt 28 is flattened.

The support-belt deforming member 28*a* presses the outer surface of the support belt 28 to elastically deform the support belt 28 so as to expand an area where a portion, between the backup roller 81 and the suspension roller 82, of the back of the transfer belt 8 comes into contact with the support belt 28.

The support-belt deforming member 28*a* is, for example, fixed at a desired position by undepicted retainers such as screws and pins, so that the deformation level of the support belt 28 is adjusted depending on the distance between the support-belt deforming member 28*a* and the suspension roller 82. Thereby, the area of contact between the back of the transfer belt 8 and the support belt 28 is adjusted.

In this way, since the support-belt deforming member 28*a* moves to elastically deform the support belt 28 so as to expand the area where the back of the transfer belt 8 is in tight contact with the support belt 28, the transfer belt 8 is more securely supported by the support belt 28 so as not to be deflected toward the backup roller 81 and the suspension roller 82. As a result, the movement of the transfer belt 8 becomes more stable.

This can prevent the formation of a gap between the paper P and the transfer belt 8 more securely, and thus, prevent the disorder of the toner image due to the electrical discharge, leading to an improvement in image formation.

Figure 10:
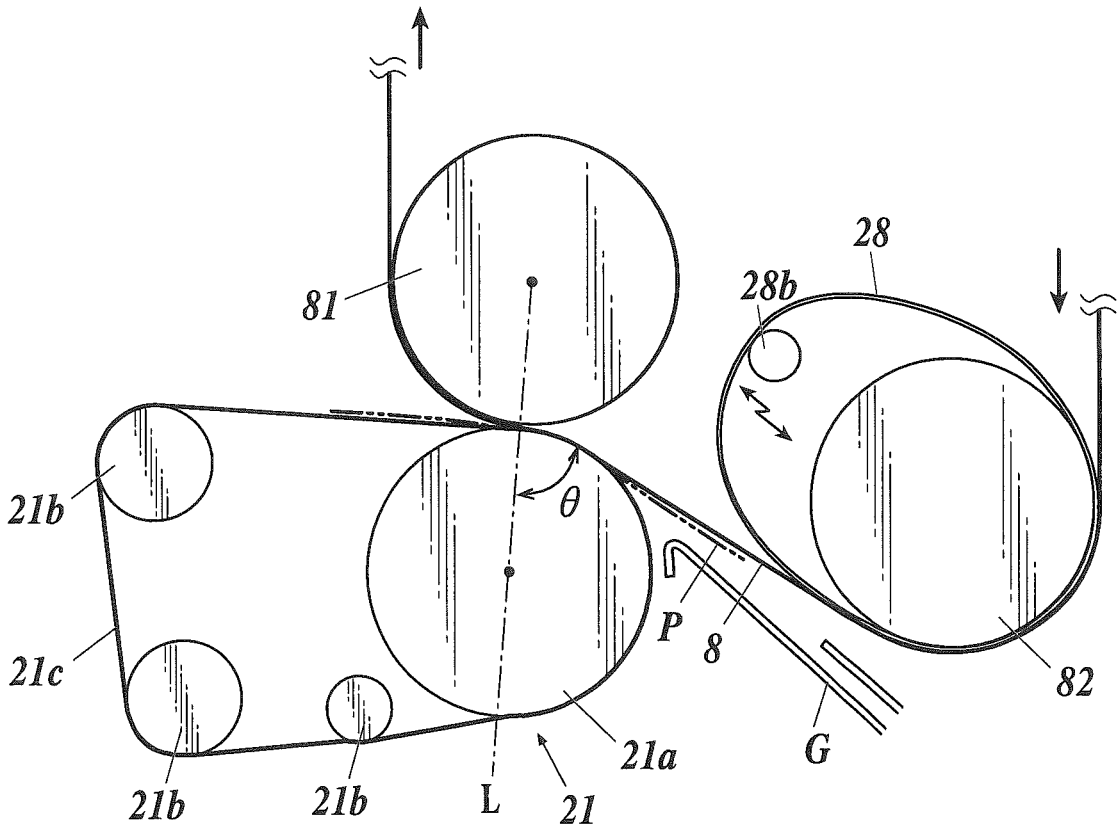
FIG. 10 illustrates the support belt and another support-belt deforming member in the second embodiment.

As shown in FIG. 10, in another preferred embodiment, the image forming apparatus includes a support-belt deforming member 28*b*. The support-belt deforming member 28*b* comes in contact with the inner surface of the support belt 28, and moves away from the suspension roller 82 over which the support belt 28 is stretched. In this way, the support belt 28 is stretched by elastic deformation.

The support-belt deforming member 28*b* presses the inner surface of the support belt 28 to elastically deform the support belt 28 so as to expand an area where a portion, between the backup roller 81 and the suspension roller 82, of the back of the transfer belt 8 comes into contact with the support belt 28.

The support-belt deforming member 28*b* is, for example, fixed at a desired position by undepicted retainers such as screws and pins, so that the deformation level of the support belt 28 is adjusted depending on the distance between the support-belt deforming member 28*b* and the suspension roller 82. Thereby, the area of contact between the back of the transfer belt 8 and the support belt 28 is adjusted.

In this way, the support-belt deforming member 28*b* moves to elastically deform the support belt 28 so as to expand the area where the back of the transfer belt 8 is in tight contact with the support belt 28, so that the transfer belt 8 is more tightly supported by the support belt 28 without deflection toward the backup roller 81 and the suspension roller 82. As a result, the movement of the transfer belt 8 becomes more stable.

This can prevent the formation of a gap between the paper P and the transfer belt 8 more securely, and thus, prevent the disorder of the toner image due to electrical discharge, leading to an improvement in image formation.

To move the support-belt deforming member 28*a* or 28*b*, the component does not necessarily need to be fixed at a desired position by the undepicted retainers. For example, a position-shifting mechanism 58 (see FIG. 7) may be activated to move the support-belt deforming member 28*a* or 28*b* so as to elastically deform the support belt 28.

The position-shifting mechanism 58 moves the support-belt deforming member 28*a* or 28*b* which is connected to the position-shifting mechanism 58 or which is disposed to receive the driving force from the position-shifting mechanism 58, in a predetermined direction so that the support belt 28 is elastically deformed.

For example, if the image forming apparatus 1 is switchable between a plain-paper print mode for image printing on plain paper such as copy paper (high-quality paper) and a thick-paper print mode for image printing on heavy thick paper, the position-shifting mechanism 58 is not activated during the plain-paper print mode; and on the other hand, the position-shifting mechanism 58 is activated to move the support-belt deforming member 28*a* or 28*b* to elastically deform the support belt 28 during the thick-paper print mode.

In this way, the thick-paper print mode is selected to activate the position-shifting mechanism 58 for image printing on the stiff thick paper, so that the support-belt deforming member 28*a* or 28*b* moves to elastically deform the support belt 18. Thereby, the area where the back of the transfer belt 8 is in tight contact with the support belt 28 is expanded. As a result, the transfer belt 8 is supported by the support belt 28 so as not to be deflected toward the backup roller 81 and the suspension roller 82. As a result, the movement of the transfer belt 8 becomes more stable.

This can prevent the formation of a gap between the paper P and the transfer belt 8, and thus, suppresses the disorder of the toner image due to the electrical discharge, leading to an improvement in image formation.

As in the first embodiment, the support belt 28 is elastically deformed only when the transfer belt 8 needs to be supported so as not to yield to a push given by the paper P, i.e., at the time of printing of thick paper, for example. This reduces a load on the support belt 28 and on the transfer belt 8 pressed by the support belt 28. In addition, such a reduction in the load on the support belt 28 and on the transfer belt 8 suppresses the deterioration of the support belt 28 and of the transfer belt 8, leading to prolonging lives of the support belt 28 and the transfer belt 8.

Third Embodiment

A third embodiment of the image forming apparatus according to the present invention is now described. The configurations similar to those in the first embodiment are designated by the same numerals and overlapping description is omitted.

The image forming apparatus 1 has an endless support belt stretched over both a backup roller 81 and a suspension roller 82, over which a transfer belt 8 is stretched, in the vicinity of the back of the transfer belt 8.

Figure 11:
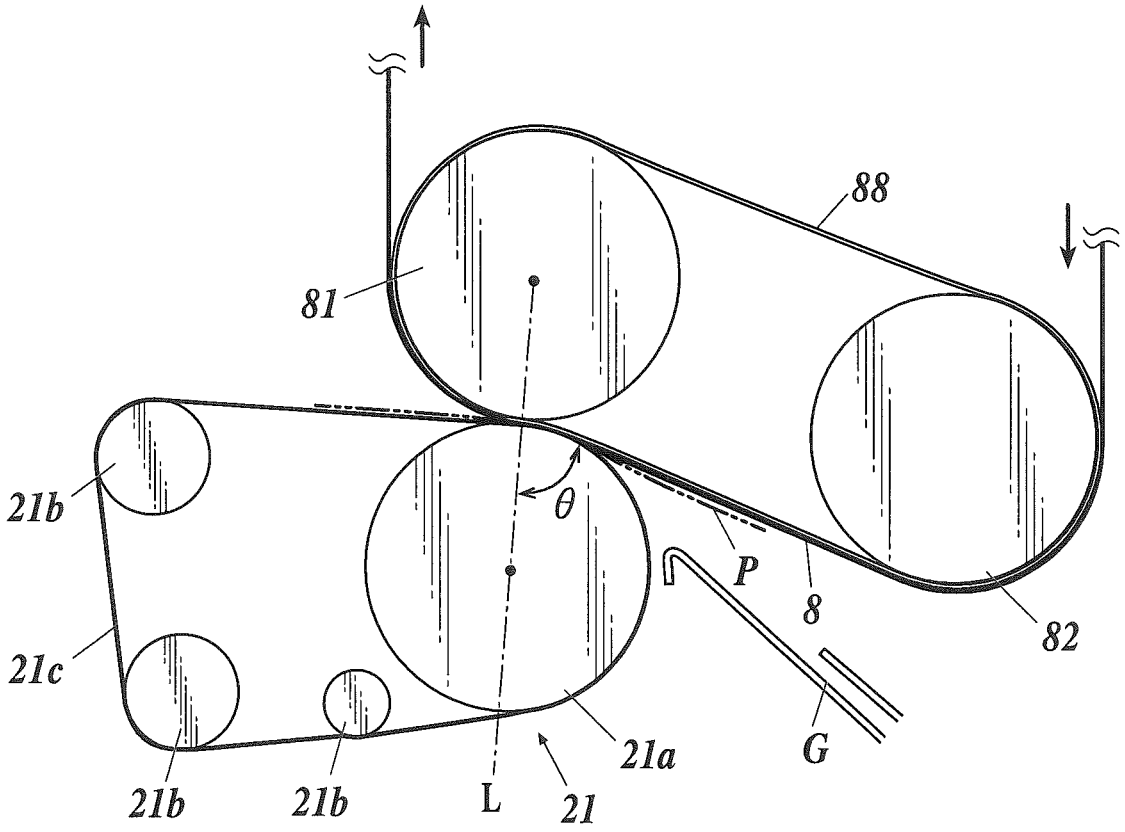
FIG. 11 illustrates a support belt and its neighborhood in a third embodiment.

As shown in FIG. 11, a support belt 88 of the third embodiment is stretched over both the backup roller 81 and the suspension roller 82, and part of the support belt 88 around both the backup roller 81 and the suspension roller 82 is held between the backup roller 81 and the transfer belt 8 and between the suspension roller 82 and the transfer belt 8.

The support belt 88 is, for example, an elastic tubular member having a Young's modulus of, for example, about 3 to about 7 MPa/mm$^2$ composed of conductive resin such as polyimide (PI), polyamide-imide (PAI), polycarbonate (PC), and polyphenylene sulfide (PPS).

The support belt 88 has substantially the same width as the transfer belt 8, and is in contact with the back of the transfer belt 8. In other words, the support belt 88 is in contact with the back of the transfer belt 8 across the full width of the transfer belt 8.

The support belt 88 prevents deflection of the transfer belt 8 toward the backup roller 81 due to the push given by the paper P during secondary transfer, and enables the transfer belt 8 to rotate stably.

As shown in FIG. 11, a secondary transfer section 21 is arranged such that the transfer belt 8 is held between the backup roller 81 and a secondary transfer roller 21*a* during the secondary-transfer mode of the image forming apparatus 1.

In this mode, the support belt 88 held between the backup roller 81 and the transfer belt 8 and between the suspension roller 82 and the transfer belt 8 comes into tight contact with the back of the transfer belt 8.

In this way, the support belt 88 is in tight contact with a portion, between the backup roller 81 and the suspension roller 82, of the back of the transfer belt 8. Accordingly, when the secondary transfer section 21 arranged such that the transfer belt 8 is held between the backup roller 81 and the secondary transfer roller 21*a*, and when the paper P nipped between the transfer belt 8 and the secondary transfer roller 21*a* for secondary transfer of the toner images onto the paper P, the transfer belt 8 is not deflected toward the backup roller 81 and the suspension roller 82 even if the transfer belt 8 is pushed by the paper P.

Specifically, the stiff paper P such as thick paper, which is conveyed along the conveyance path R, is nipped between the secondary transfer section 21 and the transfer belt 8, and then exits from the guide G on the conveyance path R. Even if the trailing end of the stiff paper P hits the transfer belt 8 as a reaction of its restoration at the timing of the exit, the transfer belt 8 is supported by the support belt 88 so as not to be deflected toward the backup roller 81 and the suspension roller 82, which achieves prevention of the movement disorder of the transfer belt 8. In this way, the transfer belt 8 is not deflected toward the backup roller 81 and the suspension roller 82, and thus the movement of the transfer belt 8 is stable, which eliminates the formation of a gap that induces electrical discharge between the paper P and the transfer belt 8. As a result, the disorder of the toner image due to the electrical discharge does not occur, leading to preferable image formation based on excellent secondary transfer.

As described above, the image forming apparatus 1 of the third embodiment has the support belt 88 that comes into tight contact with the back of the transfer belt 8 to support the transfer belt 8 so as to prevent deflection of the transfer belt 8 to the backup roller 81 and the suspension roller 82 due to the push given by the paper P during secondary transfer. As a result, the transfer belt 8 is not deflected toward the backup roller 81 and the suspension roller 82 even if the trailing end of the stiff paper P such as thick paper hits the transfer belt 8, which achieves prevention of the movement disorder of the transfer belt 8.

In this way, the support belt 88 stabilizes the movement of the transfer belt 8 during secondary transfer. This can prevent the formation of a gap that induces electrical discharge between the paper P and the transfer belt 8, leading to suppression of the disorder of the toner image due to the electrical discharge. As a result, the image forming apparatus 1 can form excellent images.

The support belt 88 preferably has substantially the same width as the transfer belt 8 so as to be in contact with the back of the transfer belt 8 across the full width of the transfer belt 8. When the stiff paper P, such as thick paper, exits from the guide G on the conveyance path R and when the trailing end of the paper P hits against the transfer belt 8, the shock caused by the hitting may concentrate on the central portion of the transfer belt 8 with respect to the width direction thereof, in some cases. In this case, it is basically sufficient that the deflection of the transfer belt 8 is restricted only in the central portion with respect to the width direction of the belt 8. In such a case, the width of the support belt 88 can be narrower than the width of the transfer belt 8 as long as the support belt 88 is provided in the region corresponding to the central portion of the transfer belt 8 with respect to the width direction thereof.

The third embodiment is not limited to the above-described examples.

Figure 12:
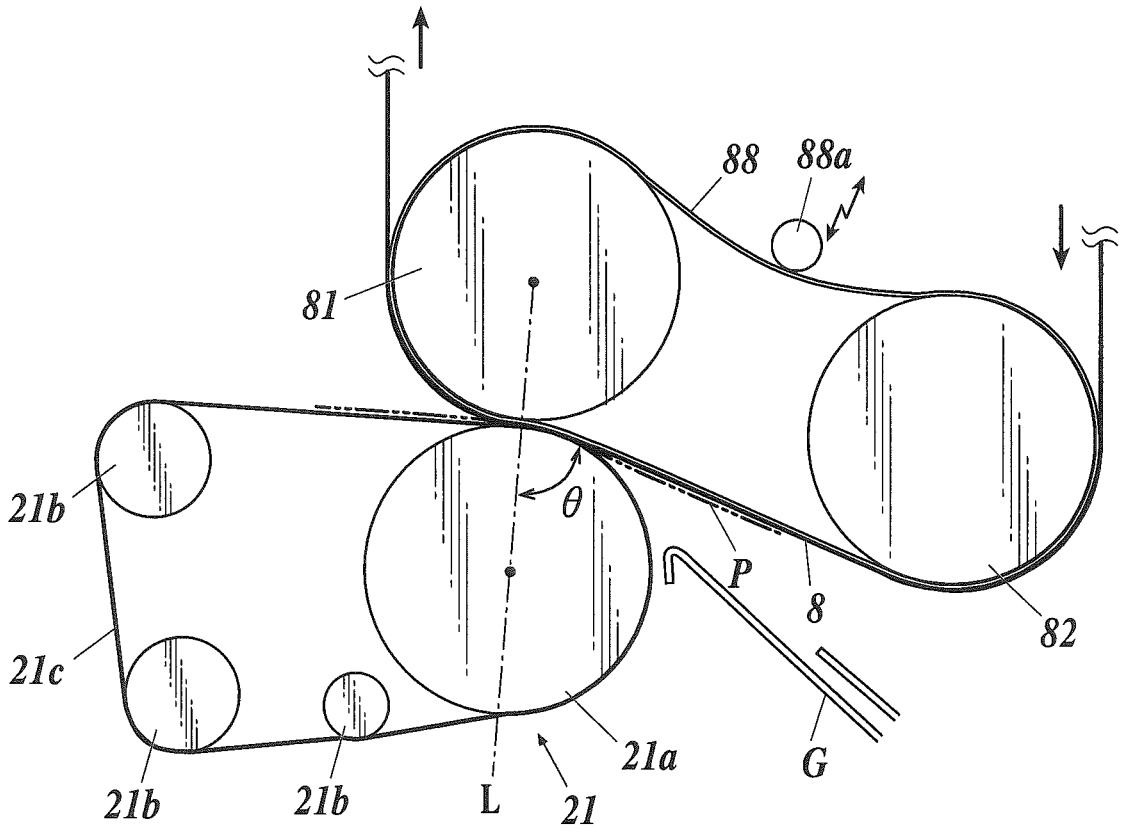
FIG. 12 illustrates the support belt and a support-belt deforming member in the third embodiment.

For example, as shown in FIG. 12, a preferred embodiment of the image forming apparatus includes a support-belt deforming member 88*a*. The support-belt deforming member 88*a* comes in contact with the outer surface of the support belt 88, and moves closer to one or both of the backup roller 81 and the suspension roller 82 over both of which the support belt 88 is stretched. In this way, the support-belt deforming member 88*a* elastically deforms the support belt 88 such that the loop of the support belt 88 is flattened.

The support-belt deforming member 88*a* presses the outer surface of the support belt 88 to elastically deform the support belt 88 so as to increase the tension of the support belt 88 stretched over both the backup roller 81 and the suspension roller 82.

The support-belt deforming member 88*a* is, for example, fixed at a desired position by undepicted retainers such as screws and pins, so that the deformation level of the support belt 88 is adjusted depending on the distance between the support-belt deforming member 88*a* and each of the backup roller 81 and the suspension roller 82, and depending on a layout of them. Thereby, the tension of the support belt 88 is adjusted.

In this way, the support-belt deforming member 88*a* moves to elastically deform the support belt 88 so as to increase tension of the support belt 88. Thereby, the transfer belt 8 is supported by the support belt 88 having increased bearing power, which prevents deflection of the transfer belt 8 toward the backup roller 81 and the suspension roller 82. As a result, the movement of the transfer belt 8 becomes more stable.

This can prevent the formation of a gap between the paper P and the transfer belt 8 more securely, and thus, prevent the disorder of the toner image due to the electrical discharge, leading to an improvement in image formation.

Figure 13:
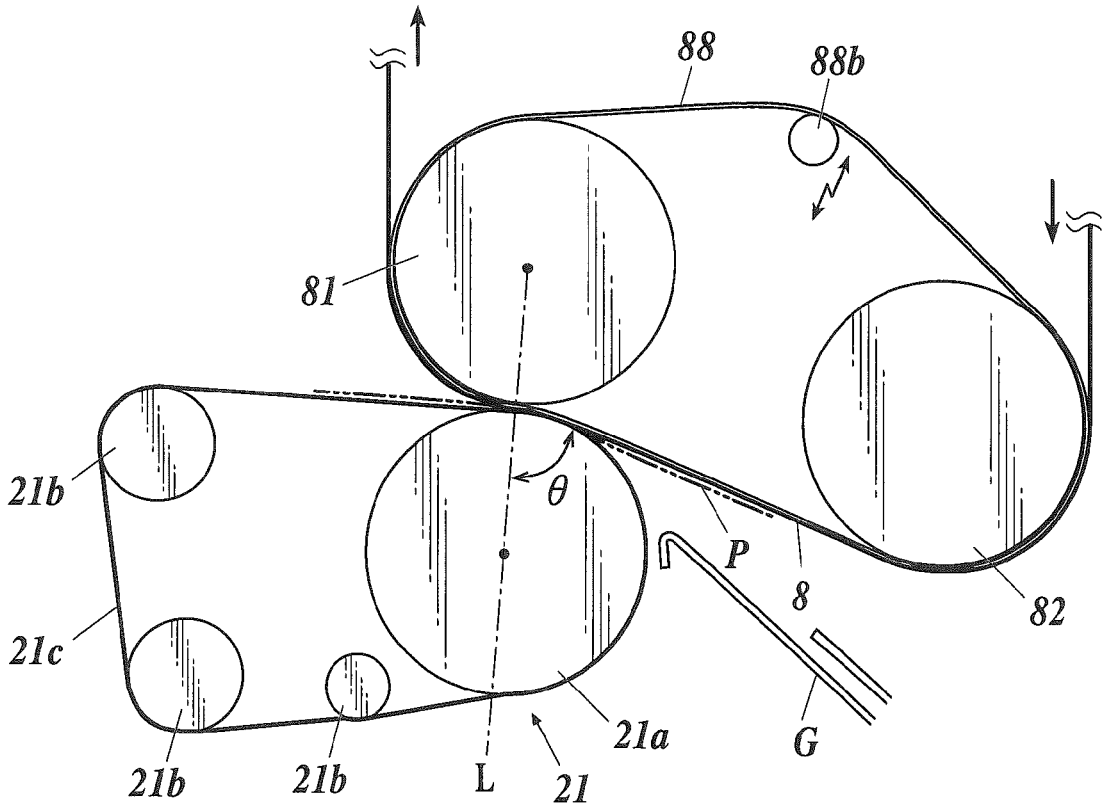
FIG. 13 illustrates the support belt and another support-belt deforming member in the third embodiment.

In another preferred embodiment, as shown in FIG. 13, the image forming apparatus includes a support-belt deforming member 88*b*. The support-belt deforming member 88*b* comes in contact with the inner surface of the support belt 88, and moves away from one or both of the backup roller 81 and the suspension roller 82 over both of which the support belt 88 is stretched. In this way, the support belt 88 is stretched and elastically deformed.

The support-belt deforming member 88*b* presses the inner surface of the support belt 88 to elastically deform the support belt 88 so as to increase the tension of the support belt 88 stretched over both the backup roller 81 and the suspension roller 82.

The support-belt deforming member 88*b* is, for example, fixed at a desired position by undepicted retainers such as screws and pins, so that the deformation level of the support belt 88 is adjusted depending on the distance between the support-belt deforming member 88*b* and each of the backup roller 81 and the suspension roller 82, and depending on the layout of them. Thereby, the tension of the support belt 88 is adjusted.

In this way, the support-belt deforming member 88*b* moves to elastically deform the support belt 88 so as to increase the tension of the support belt 88. Thereby, the transfer belt 8 is supported by the support belt 88 having increased bearing power, which prevents deflection of the transfer belt 8 toward the backup roller 81 and the suspension roller 82. As a result, the movement of the transfer belt 8 becomes more stable.

This can prevent the formation of a gap between the paper P and the transfer belt 8 more securely, and thus, prevent the disorder of the toner image due to the electrical discharge, leading to an improvement in image formation.

To move the support-belt deforming member 88*a* or 88*b*, the component does not necessarily need to be fixed at a desired position by the undepicted retainers. For example, a position-shifting mechanism 58 (see FIG. 7) may be activated to move the support-belt deforming member 88*a* or 88*b* so as to elastically deform the support belt 88.

The position-shifting mechanism 58 moves the support-belt deforming member 88*a* or 88*b*, which is connected to the position-shifting mechanism 58 or which is disposed to receive the driving force from the position-shifting mechanism 58, in a predetermined direction so that the support belt 88 is elastically deformed.

For example, if the image forming apparatus 1 is switchable between the plain-paper print mode for image printing on plain paper such as copy paper (high-quality paper) and the thick-paper print mode for image printing on heavy thick paper, the position-shifting mechanism 58 is not activated during the plain-paper print mode; and on the other hand, the position-shifting mechanism 58 is activated to move the support-belt deforming member 88*a* or 88*b* to elastically deform the support belt 88 during the thick-paper print mode.

In this way, the thick-paper print mode is selected to activate the position-shifting mechanism 58 for image printing on the stiff thick paper, so that the support-belt deforming member 88*a* or 88*b* moves to elastically deform the support belt 88. Thereby, the tension of the support belt 88 is increased. As a result, the transfer belt 8 is supported by the support belt 88 having increased bearing power so that the transfer belt 8 is not deflected toward the backup roller 81 and the suspension roller 82. As a result, the movement of the transfer belt 8 becomes more stable.

This can prevent the formation of a gap between the paper P and the transfer belt 8, and thus, suppresses the disorder of the toner image due to the electrical discharge, leading to an improvement in image formation.

As in the first embodiment, the support belt 88 is elastically deformed only when the transfer belt 8 needs to be supported so as not to yield to a push given by the paper P, i.e., at the time of printing of thick paper, for example. This reduces a load on the support belt 88 and on the transfer belt 8 pressed by the support belt 88. In addition, such a reduction in the load on the support belt 88 and on the transfer belt 8 suppresses the deterioration of the support belt 88 and of the transfer belt 8, leading to prolonging lives of the support belt 88 and the transfer belt 8.

The entire disclosure of Japanese Patent Application No. 2011-098897 filed on Apr. 27, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

a transfer belt having a surface on which a toner image is primarily transferred, the transfer belt rotating in a predetermined direction;

a pressure receiving roller over which the transfer belt is stretched;

a suspension roller over which the transfer belt is stretched, the suspension roller disposed upstream from the pressure receiving roller;

a secondary transfer roller that presses the transfer belt against the pressure receiving roller;

an endless support belt stretched over at least one of the pressure receiving roller and the suspension roller; and a support-belt deforming member that elastically deforms the support belt so as to expand an area where a portion, between the pressure receiving roller and the suspension roller, of a back side of the transfer belt comes into contact with the support belt, wherein when the transfer belt is pressed between the pressure receiving roller and the secondary transfer roller, and paper is nipped between the transfer belt and the secondary transfer roller for secondary transfer of the toner image onto the paper, an angle defined by a portion, upstream from the secondary transfer roller, of the surface of the transfer belt and an imaginary line connecting an axis of the pressure receiving roller with an axis of the secondary transfer roller is less than 90 degrees; and a part of the support belt is held between the transfer belt and the at least one of the pressure receiving roller and the suspension roller over which the support belt is stretched.

2. The image forming apparatus according to claim 1, wherein the support-belt deforming member elastically deforms the support belt by coming in contact with an outer surface of the support belt, and by moving closer to the at least one of the pressure receiving roller and the suspension roller over which the support belt is stretched.

3. The image forming apparatus according to claim 1, wherein the support-belt deforming member elastically deforms the support belt by coming in contact with an inner surface of the support belt, and by moving away from the at least one of the pressure receiving roller and the suspension roller over which the support belt is stretched.

4. The image forming apparatus according to claim 1, further comprising:

a position-shifting mechanism that shifts a position of the support-belt deforming member so as to elastically deform the support belt, and a controller that controls the position-shifting mechanism so as to move the support-belt deforming member at least when the paper is nipped between the transfer belt and the secondary transfer roller.

5. The image forming apparatus according to claim 1, wherein the support belt has substantially the same width as the transfer belt.

6. The image forming apparatus according to claim 1, wherein the support belt has a width narrower than the width of the transfer belt, and is disposed at a position corresponding to a central portion of the transfer belt with respect to a width direction thereof.

7. An image forming apparatus comprising:

a transfer belt having a surface on which a toner image is primarily transferred, the transfer belt rotating in a predetermined direction;

a pressure receiving roller over which the transfer belt is stretched;

a suspension roller over which the transfer belt is stretched, the suspension roller disposed upstream from the pressure receiving roller;

a secondary transfer roller that presses the transfer belt against the pressure receiving roller;

an endless support belt stretched over both the pressure receiving roller and the suspension roller; and a support-belt deforming member that elastically deforms the support belt so as to increase tension of the support belt stretched over both the pressure receiving roller and the suspension roller, wherein when the transfer belt is pressed between the pressure receiving roller and the secondary transfer roller, and paper is nipped between the transfer belt and the secondary transfer roller for secondary transfer of the toner image onto the paper, an angle defined by a portion, upstream from the secondary transfer roller, of the surface of the transfer belt and an imaginary line connecting an axis of the pressure receiving roller with an axis of the secondary transfer roller is less than 90 degrees; and a part of the support belt is held between the transfer belt and the pressure receiving roller and between the transfer belt and the suspension roller.

8. The image forming apparatus according to claim 7, wherein the support-belt deforming member elastically deforms the support belt by coming in contact with an outer surface of the support belt, and by moving closer to at least one of the pressure receiving roller and the suspension roller.

9. The image forming apparatus according to claim 7, wherein the support-belt deforming member elastically deforms the support belt by coming in contact with an inner surface of the support belt, and by moving away from at least one of the pressure receiving roller and the suspension roller.

10. The image forming apparatus according to claim 7, further comprising:

a position-shifting mechanism that shifts a position of the support-belt deforming member so as to elastically deform the support belt, and a controller that controls the position-shifting mechanism so as to move the support-belt deforming member at least when the paper is nipped between the transfer belt and the secondary transfer roller.

11. The image forming apparatus according to claim 7, wherein the support belt has substantially the same width as the transfer belt.

12. The image forming apparatus according to claim 7, wherein the support belt has a width narrower than the width of the transfer belt, and is disposed at a position corresponding to a central portion of the transfer belt with respect to a width direction thereof.

* * * * *